US006467116B1

(12) United States Patent
Strickland

(10) Patent No.: US 6,467,116 B1
(45) **Date of Patent: *Oct. 22, 2002**

(54) SEALANT SYSTEM FOR WATERPROOFING WELTED FOOTWEAR

(75) Inventor: Barbara A. Strickland, Hudson, NH (US)

(73) Assignee: Worthen Industries, Inc., Nashua, NH (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

This patent is subject to a terminal disclaimer.

(21) Appl. No.: 09/050,772

(22) Filed: Mar. 30, 1998

Related U.S. Application Data

(63) Continuation-in-part of application No. 08/509,170, filed on Jul. 31, 1995, now Pat. No. 5,732,429.

(51) Int. Cl.[7] ..... A43B 13/39

(52) U.S. Cl. ..... 12/142 D; 36/17 R; 36/55

(58) Field of Search ..... 36/17 R, 17 PW, 36/55; 12/142 D

(56) References Cited

U.S. PATENT DOCUMENTS

| | | | | |
|---|---|---|---|---|
| 898,710 | A | | 9/1908 | White |
| 1,136,799 | A | | 4/1915 | Harris |
| 1,136,819 | A | | 4/1915 | Lenker |
| 1,937,826 | A | | 12/1933 | Lineham |
| 1,993,954 | A | | 3/1935 | Bates |
| 2,084,874 | A | | 6/1937 | Sutcliffe |
| 2,480,689 | A | | 8/1949 | Allen |
| 3,028,690 | A | * | 4/1962 | Bailey |
| 5,732,429 | A | * | 3/1998 | Strickland |

OTHER PUBLICATIONS

Manual of Shoemaking, p. 289, copyright 1976, 1976.

* cited by examiner

*Primary Examiner*—Ted Kavanaugh
(74) *Attorney, Agent, or Firm*—Samuels, Gauthier & Stevens

(57) ABSTRACT

A laminated waterproof footwear assembly. Where the footwear components are stitched together a gel-like sealant is placed on at least one surface of the footwear components to be joined together. A needle carrying a thread passes through the footwear components carrying the gel with it. The gel dams the hole and forms a waterproof seal.

16 Claims, 5 Drawing Sheets

SEALANT SYSTEM FOR WATERPROOFING WELTED FOOTWEAR

CROSS-REFERENCE TO RELATED APPLICATION(S)

This application is a continuation-in-part application of U.S. patent application Ser. No. 08/509,170 filed Jul. 31, 1995 now U.S. Pat. No. 5,732,429 issued March 31, 1998.

BACKGROUND OF THE INVENTION

1. Field of the Invention

The invention relates to a gel for sealing holes for waterproofing stitched footwear.

2. Discussion of the Prior Art

In the manufacture of footwear products, one of the manufacturing steps for many of these products is a stitching step wherein two materials of the footwear construction are joined together by a needle carrying thread through the hole caused by the needle. There are several footwear manufacturing processes that stitch materials together, for example, the well known basic welt process, modified welt process, the littleway process, the triple (or double) needle process, the stitchdown process and the sidewall process.

In the welt process, an insole rib is attached to an insole. The inner surface of the rib defines a rib cavity. A welt is stitched to an upper and to the outer surface of the insole rib, typically by chain stitches. Normally, a lining is interposed between the upper and the rib.

Historically, the problem with welt shoes is that they leak, that is they are not waterproof, unless they are manufactured with a full waterproof bootie or double lasted with a waterproof membrane. The problem with these systems is that not only do they encourage heat build-up inside the shoe but they also increase the weight and cost of the shoes. In welted footwear the 'leaking' is primarily through the holes formed by the needle during chain stitching and water seeping into the footwear from the rib cavity. Similarly, with the other types of stitched constructions, leaking is a problem and the current techniques used to waterproof the stitched areas reduce the breathability of the material and/or are not aesthetically pleasing.

SUMMARY OF THE INVENTION

The sealants of the invention overcome this leaking by sealing the holes formed during stitching.

Broadly the invention comprises applying a gel-like sealant to at least one surface of a first footwear component which is to be joined to a second piece of footwear component by stitching. The needle passes through the first footwear component, the gel and the second footwear component to stitch the materials together. After the needle withdraws, the gel seals the stitched hole caused by the needle.

The preferred embodiment of the invention will be described with reference to the basic welted footwear construction. Alternative embodiments of the invention employ the gel for stitching in the modified welt process, littleway process, the triple needle process, the stitchdown process and/or the sidewall process.

An upper footwear assembly usually comprises an upper and a lining which are stitched to the insole rib, in the same stitching step which attaches the welt to the rib.

In the system of the invention, a sealing gel, preferably in the form of a bead, is placed along the outer surface of the rib prior to stitching the welt/upper/liner/rib. When these materials are stitched, the needle carries the gel into the holes and seals the holes formed in the welt/upper/liner/rib. This blocks any water from entering the footwear through the needle holes of the chain stitching.

Although the gel seals the holes formed, the construction is still a sandwiched construction of welt/upper/lining/rib. It is possible for water to seep between the upper and the lining. Accordingly, in another aspect of the invention, prior to stitching the welt/upper/lining to the rib, the sealing gel, preferably in the form of a tape, is placed between the upper and the lining. The tape can be placed so that it overlays the stitch line or is just above the stitch line.

In welted footwear construction the heel assemblies vary and the rib may not extend along the entire perimeter of the inner sole. Different manufacturing steps are employed to fasten the heel to the sole. For example the rib and welt may be trimmed away at the heel and the upper/lining fastened directly to the inner sole. In this embodiment, the sealing gel (tape) is still used between the upper and the lining. Where the upper and lining are nailed to the inner sole on the heel section, the sealing gel, preferably in the form of a flat gasket, is placed under the heel section of the inner sole and then the upper/tape/lining is fastened to the inner sole.

Lastly, in the system of the invention a liquid sealant is coated in the cavity defined by the rib, specifically by applying a sealer inside the rib cavity and on the top of the rib after inseaming (attaching the welt to the insole and trimming).

DESCRIPTION OF THE PREFERRED EMBODIMENT(S)

The waterproofing system of the invention described hereinafter exceeds the standard for footwear water impermeability based on the acceptable failure under water-flex conditions after more than 2,000 flexes. The prior art bootie or double lasted membrane system usually shows failure at 3,500–4,000 flexes. The above system of the invention has consistently passed the flexibility test even at more than 8,000 flexes. The standard test used is a water-immersion flex-tester.

For the preferred embodiment of the invention, the system of the invention will be described with reference to specific formulations which fall generally into two categories of sealants. A first sealing gel which is used primarily in the assembly of the footwear where a needle pierces the footwear during assembly. The hole formed by the piercing needle, if left unsealed, forms a path for the flow of water from the exterior of the shoe into the interior of the final assembled shoe. The other sealant of the invention is a coating sealant which is coated on the inside of the rib cavity after the welt has been attached.

In the alternative embodiments of the invention, only the first sealing gel is used.

Although the preferred and alternative embodiments is described in reference to a needle and stitch line, it embraces any assembly operation such as nailing, stapling and the like where penetration of a needle or insertion of a fastener is contemplated.

The System

Figure 1:
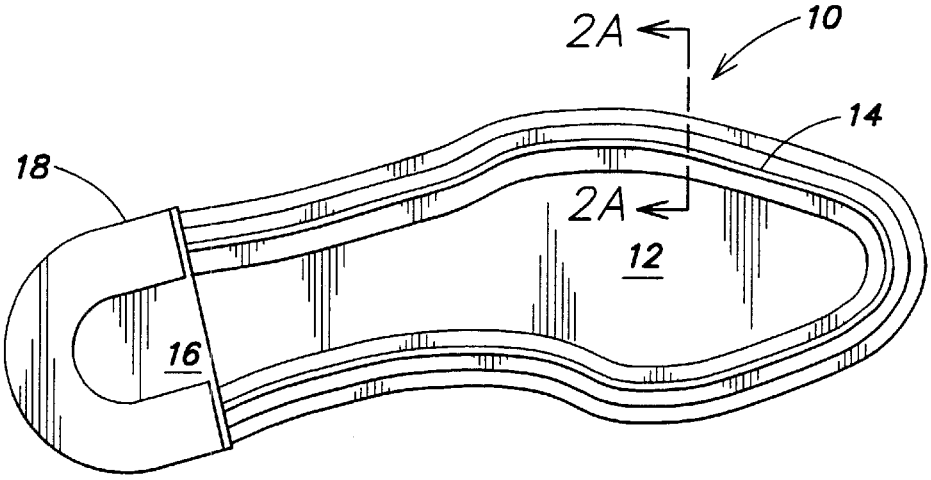
FIG. 1 is an illustration of an insole having a rib secured thereon.

Referring to FIG. 1, a ¾ welt construction inner sole is generally shown at 10 and comprises an inner sole 12 having an insole rib 14 secured thereto. The inner sole is also characterized by a sealing gasket 16 over which is a heel insert 18 such as a 'dutchman'.

Figure 2A:
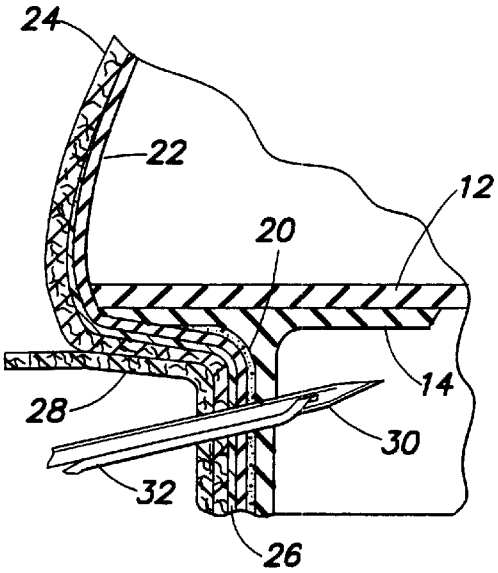
FIG. 2*a* is a sectional view of FIG. 1 taken along the lines 2—2 of FIG. 1 illustrating the welt/upper/tape/lining/rib construction before stitching.
Figure 2B:
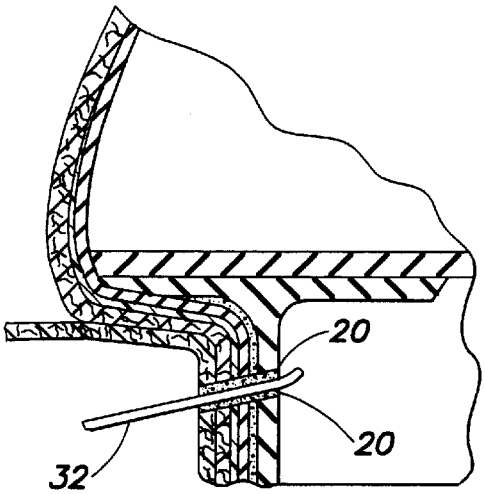
FIG. 2*b* is a sectional view of FIG. 1 taken along the lines 2—2 of FIG. 1 illustrating the welt/upper/tape/lining/rib construction after stitching.

Referring to FIG. 2*a* and FIG. 2*b*, the welted footwear construction is shown in greater detail and illustrates a sealing gel 20 which originally was placed in a bead-like line along the outer edge of the rib. A lining 22 and an upper 24 are shown and between the lining and the upper is a sealing gel in the form of a tape 26. Lastly, a welt 28 is adjacent the upper 24.

In the attachment of the welt/upper/tape/lining to the rib, a needle 30 penetrates this assembly carrying with it a thread 32. When the needle penetrates this assembly it punctures and carries with it a portion of the gel 20.

As shown in FIG. 2*b*, when the needle is withdrawn the gel remains in the hole formed by the needle, sealing the same.

Figure 3:
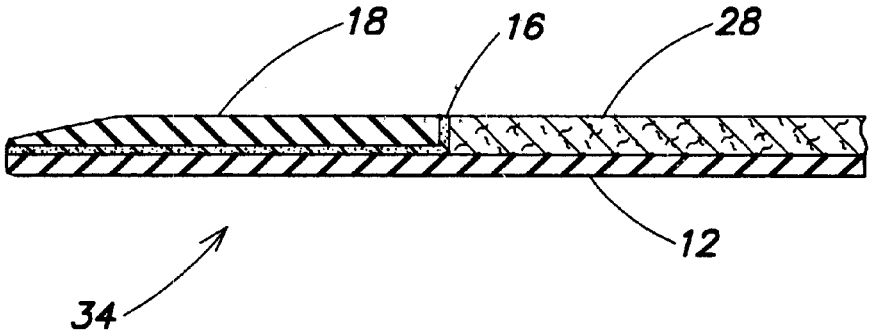
FIG. 3 is a side view of a ¾ welt construction with the welt and rib trimmed.

Referring to FIG. 3, for the ¾ welt construction disclosed herein, the welt and rib are trimmed away from the heel section designated generally as 34. In the heel section 34 is the sealing gasket 16. Also shown is the dutchman 18.

As shown in FIG. 3, the gasket 16 is turned up at its end where it interfaces with the trimmed rib welt 28.

Figure 4:
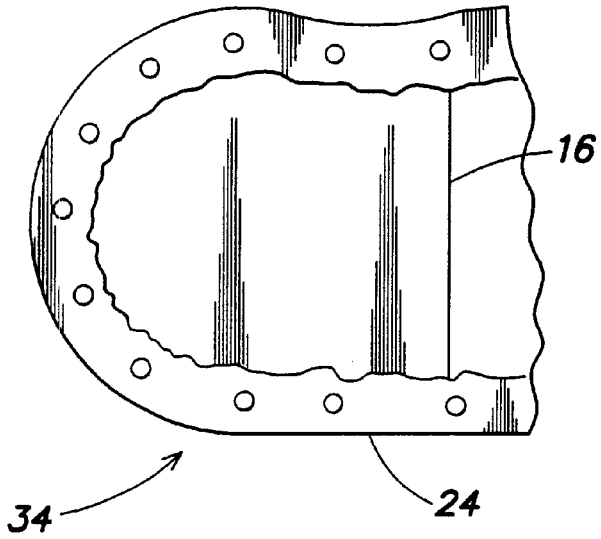
FIG. 4 is a bottom view of a heel section of FIG. 3 illustrating a nail line.

Referring to FIG. 4, the heel section 34 is shown without the dutchman but with the upper/tape/lining nailed to the inner sole through the gasket 16.

Lastly, referring to FIG. 1, the rib cavity, which in this preferred embodiment, again, is defined by the rib and the gasket 16 has coated thereon a liquid sealant to fully waterproof the shoe.

Sealing Gels

EXAMPLE I

Upaco 5750

The following ingredients were mixed at ambient temperature and pressure:

| Weight lbs. | Ingredients | |
|---|---|---|
| 84.45 | Joncryl 74F | |
| 0.50 | Merrol N303 | |
| 15.05 | Alcogum 6940 | |
| **Description** | **Value** | |
| RVT | #6/10/25'C | |
| Visc | 42,000–48,000 CPS | |
| Overnight Visc Record | | |
| Flash Solids | 38–42% | |
| pH | 8.0 minimum | |
| Joncryl 74F | S.C. Johnson Polymer | Acrylic emulsion-48.5% |
| Alcogum | Alco Chemical Corp. | Sodium polyacrylate thickener |
| Merrol N303 | Merrand International | Plasticizer |

EXAMPLE II

Upaco 9042

| Weight lbs. | Ingredients | |
|---|---|---|
| 600.0 | Eastoflex E-1003 heat to melting then add slowly | |
| 200.0 | Rextax 2535 Allow to melt completely, then add . . . | |
| 200.0 | Rextax 2535 | |
| 1000.0 | Spindle 27, speed 50, temp. 350° F., Range 1000–1500 cps. | |
| Eastoflex E-1003 | Eastman Chemical | Amorphouspolyolefin-APO |
| Rextax 2535 | Rexene Corp. | Amorphous polyalpha-olefin-APAO |

The sealing gels of the invention can be comprised of an amorphous polyolefin comprising greater than 99% propylene ethylene copolymer, the amorphous polyolefin present in the composition in an amount of 20 to 90% by weight based on the total weight of the composition, and an amorphous polyalphaolefin copolymer, the amorphous polyalphaolefin present in the composition in an amount of 80 to 10% by weight based on the total weight of the composition.

Other possible sealing compositions include acrylics, polyalphaolefins, SBS and SIS copolymers, urethanes, chlorinated rubber compounds and extended versions thereof.

The above compositions can either be extruded in bead-like form or as a tape. When they are to be applied to the insole rib, the compositions are preferably extruded in bead-like form. Additionally, the composition is formulated to be dimensionally stable or free standing.

The above compositions can also be extruded onto release paper and used as a gasketing material for the heel section as will be described. They have also been cast on various backers, made into a tape and used between the lining and the upper. The tape may also be used between other pieces to be stitched together, as a way to self-seal the stitch holes. To form sealing tape, the compositions can also be extruded at thicknesses of 5 mils to 50 mils onto release paper, or non-wovens, polyolefin films, or fabrics in thicknesses from <1 mil to 100 mils. In one embodiment of the invention, the sealant is applied to the release paper and the release paper is removably attached to at least one of the footwear components. When the release paper is removed, the sealant remains adhered to the footwear component.

The above compositions for sealing beads, gaskets or tapes have rheological and sealing properties which are especially adapted for use in combination with the stitching steps and/or nailing steps in the assembly of the footwear components. More specifically, after the gel is extruded its outer surface 'sets'. For a liquid bead (Example I) extruded at a diameter of 5 cm, the outer surface would 'set' between 30 to 60 minutes. Typically, the bead is extruded directly on the rib. The center remains soft and does not set for between 3 to 5 hours. When extruded hot (Example II) as a bead, say in a dimension of 3 cm the outer surface sets between 30 to 60 seconds after which it is dimensionally stable and may be handled. The center of the bead remains soft and flexible for a minimum of 30 days.

Sealing Liquids

EXAMPLE III

Upaco 5711

The following ingredients were mixed at ambient temperature and pressure until homogenous.

| Weight lbs. | Ingredients |
|---|---|
| 71.96 | Joncryl 74F |
| 21.94 | Dispercoll 8464 |
| Check pH of Dispercoll before adding - must be 6.0 min | |
| 0.10 | Alcogum 6940 |

| Description | Target |
|---|---|
| RVT | 1/20/25'C |
| Visc | 200–300 CPS |
| Overnight Visc Record | |
| Flash Solids | 34–37% |
| Solids | 34–37% |
| pH | Record |
| Color | White |

EXAMPLE IV

Upaco 5722

The following ingredients were mixed at ambient temperature and pressure until homogenous.

| Weight lbs. | Ingredients |
|---|---|
| 77.14 | Joncryl 74F |
| 22.04 | Dispercoll 8464 |

-continued

| | | |
|---|---|---|
| Check pH of dispercoll before adding - must be 6.0 min | | |
| 0.82 | Alcogum 6940 | |
| Mix at least 20 min. | | |

| Description | Target | |
|---|---|---|
| RVT | 2/20/25'C | |
| Visc | 500–600 CPS | |
| Solids | 40–45% | |
| pH | Record | |
| Color | White | |
| Joncryl 74F | S.C. Johnson Polymer | Acrylic emulsion-48.5% |
| Dispercoll 8464 | Bayer, Inc. | Polyurethane dispersion-40% |
| Alcogum | Alco Chemical Corp. | Sodium polyacrylate thickener |

EXAMPLE V

Upaco No. 5750, a high viscosity acrylic "gel", was extruded around the outside of the rib manually using a squeeze bottle with a ¼" opening. After the gel was extruded, it had to set between one hour and three hours of extrusion; the gel was (crusty) on the outside but still liquid inside. The No. 5750 gel was brushed onto the lining prior to side lasting to form a barrier to prevent water leaking between the lining and the upper. The welts were stitched.

Upaco No. 9023A was used as a heel seat gasket. This material is extruded into the heel area to seal around the heel nail holes and fill the gap between the end of the welt and the "Dutchman" in ¾ welt shoes. This material was also extruded onto a release lining and die cut to cover the full heel area before nailing; when nailed through, it flowed into the nail holes and plugged them, much like the gel flows into and plugs the welt stitch holes. The sealed welted footwear was tested according to immersion water-flex test standards and did not fail until 16,000 flexes.

A thin sealer, No. 5711, was coated on the inside of the rib cavity, paying special attention to the inside stitch holes. The coating thickness was 1 mil. After one hour a second coat of sealer, using No. 5722, was applied to the entire inside rib area, the inseam (top of the trimmed rib) and the insole tack holes. The coating thickness was 2 mils.

Discussion

These sealing liquids give a fully waterproof welt shoe without a membrane or bootie. The 5700-type liquid systems are made of compounded acrylic emulsions. The compounding is to enhance rheological properties and water-resistance, especially at the lower viscosities. Sealers (5711/5722) are coated inside the entire rib cavity as a safety measure to further block water from entering.

In general No. 9042 is extruded directly onto the rib, stays soft and flexible, and has virtually no time limitations for application. This material is a blend of two amorphous polyolefins and must be extruded hot (325–340° F.).

The extruded gel bead on the rib (5750 or 9042) is compressed between the lining and the rib. The welt is sewn on (needle pieces welt, upper, gasket/tape, lining, gel and rib). The gel forms a dam around needle holes and also pulls through into the hole to block water coming from outside. The gasket/tape is between the upper and lining at and slightly above the stitching to stop seeping water between the lining and the upper.

After being extruded the gel initially sets with a stable outer shell with a viscous inner core. This provides dimensional stability to the gel such that it remains in place during subsequent handling and stitching operations. As is well known, the needle which carries the thread has a greater dimension than the thread. When the needle punches through the materials to be sewn, a larger hole is necessarily formed than the dimension of the thread. The needle when punching through the gel carries with it the viscous core of the gel which fills and seals the hole. Further, the exposed surface of the gel which the needle initially punches through and then withdraws self-seals on its surface. Further, the gel fills and seals along the length of the hole formed.

In the following discussion of the alternative embodiments of the invention when reference is made to a 'stitch line' this is means that two pieces of footwear construction material have been stitched (sewn together) and the thread and sealing gel are shown with the thread as a solid line and the sealing gel as stippling on either side of the solid line. For the embodiments of FIGS. 5, 6, 7, 8 and 9 the sealing gel, UPACO 9042, is used to seal the stitch holes. Prior to stitching the gel is applied preferably as a tape to either of the facing surfaces of the materials to be joined.

Figure 5:
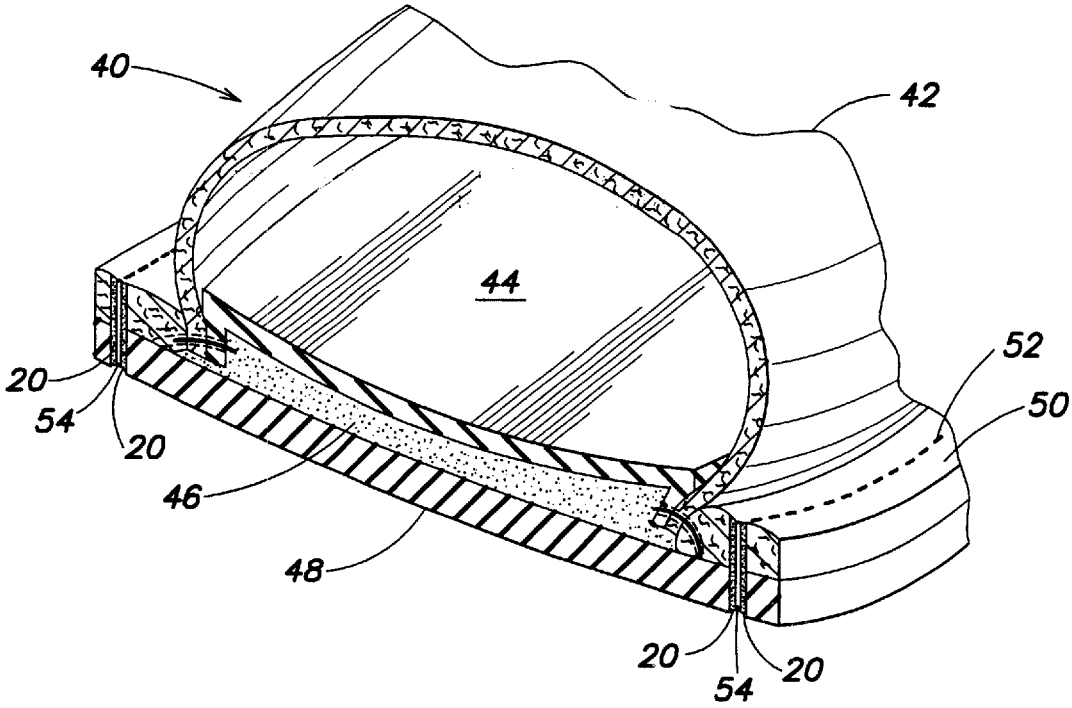
FIG. 5 is an illustration of the stitching of a modified welt process.

Referring to FIG. 5, a modified welt construction is shown generally at 40 and comprises an upper 42, an insole 44, bottom filling 46, an outer sole 48 is stitched through a welt 50 along stitch line 52 (this is the second stitching process). Thread 54 is surrounded by gel 20.

Figure 6:
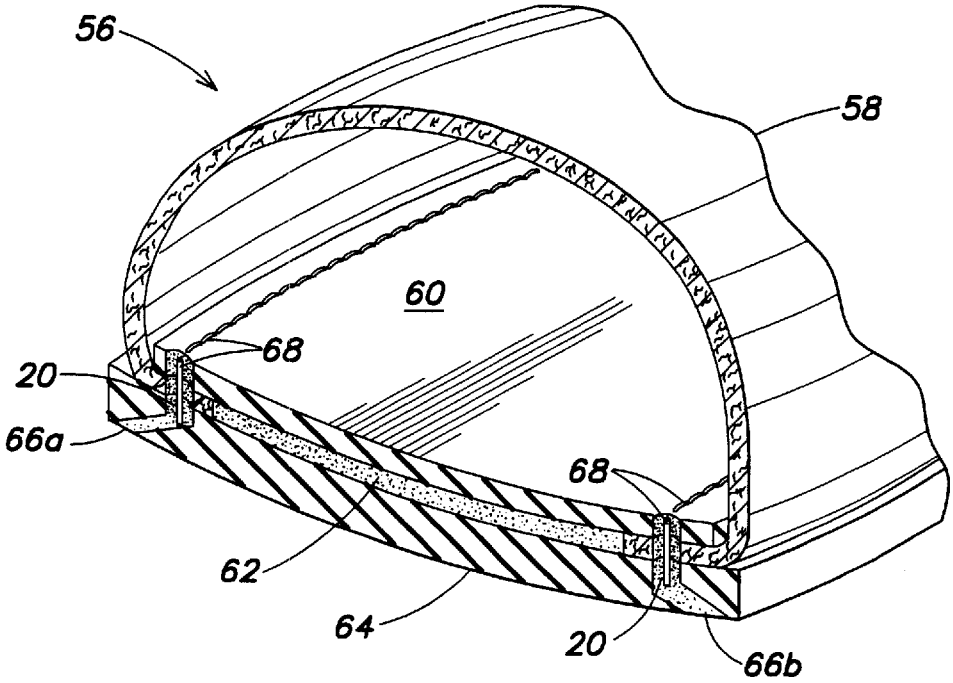
FIG. 6 is an illustration of the stitching of the littleway process.

Referring to FIG. 6, a littleway stitching construction is shown generally at 56 and comprises an upper 58, an insole 60, bottom filling 62 and outer sole 64. There are channels or slits 66*a* and 66*b* formed in the outer sole 64. The outer sole is attached to the insole by thread 68. The gel 20 surrounds the thread 68.

Figure 7:
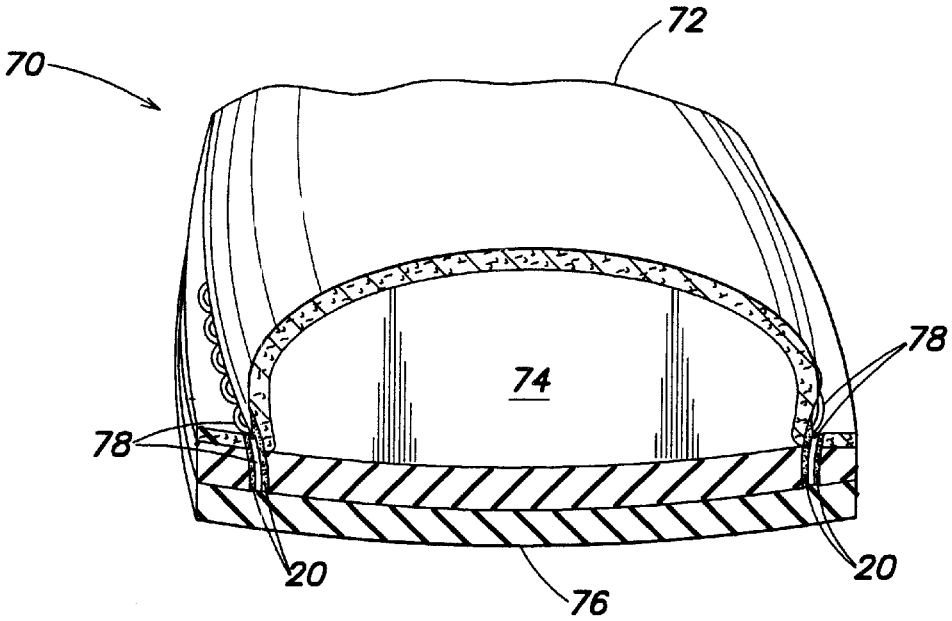
FIG. 7 is an illustration of the triple needle process.

Referring to FIG. 7, a stitch-down construction is shown generally at 70 and comprises an upper 72, a runner 74 and an outer sole 76. In this stitchdown construction, the upper 72 is flanged out over the sole 70 and stitched thread by thread. The threads are shown at 78. The gel is shown as 20.

Figure 8:
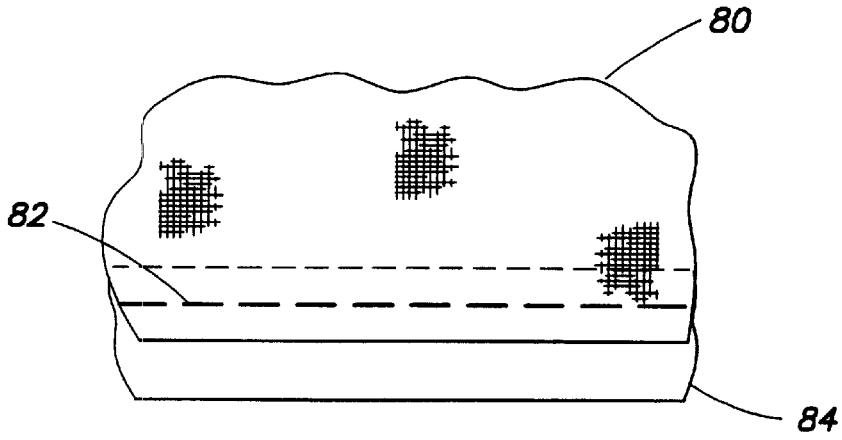
FIG. 8 is an illustration of the stitchdown process.

Referring to FIG. 8, a fragmentary side view of a shoe construction is shown for sidewall stitching typically found on boat shoe, hiking or some forms of athletic footwear. An upper 80 is stitched by thread 82 to the wall of the bottom 84.

Figure 9:
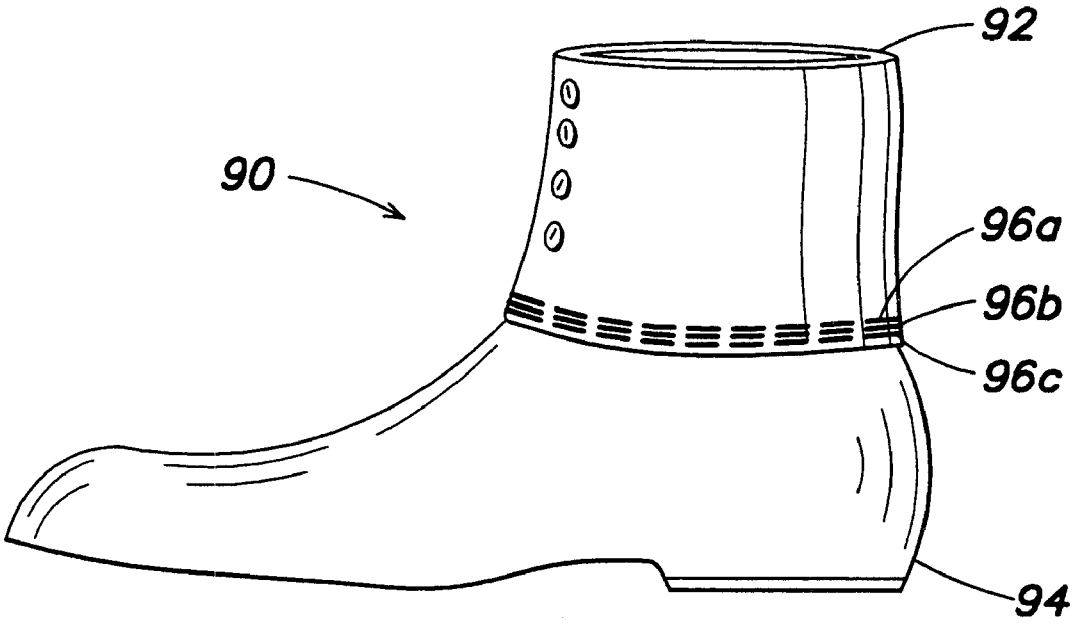
FIG. 9 is an illustration of stitching with the sidewall process.

Referring to FIG. 9, a side view of a footwear construction is shown for three needle stitch is shown generally at 90 and comprises an upper leather shaft 92 stitched to a lower molded shell bottom 94 along stitch lines 96*a*, 96*b* and 96*c*.

Although described with reference to sealing materials for footwear construction together, other applications, such as for stitching of tents, tent seams, backpacks, etc. are within the scope of the invention where it is important that holes caused by a stitching process be sealed.

The foregoing description has been limited to specific embodiments of the invention. It will be apparent, however, that variations and modifications can be made to the invention, with the attainment of some or all of the advantages of the invention. Therefore, it is the object of the appended claims to cover all such variations and modifications as come within the true spirit and scope of the invention.

Having described my invention, what I now claim is:

1. A method for waterproofing a stitched footwear construction, which construction meets a standard water immersion flex test, where a first footwear component is secured to a second footwear component by stitching with a threaded needle, the needle being dimensionally larger than the thread it carries, which method comprises:

applying a sealant to the surface of one of said components, the sealant comprising an amorphous polyolefin comprising greater than 99% propylene ethylene copolymer, the amorphous polyolefin present in the composition in an amount of 20 to 90% by weight based on the total weight of the composition, and an amorphous polyalphaolefin copolymer, the amorphous polyalphaolefin present in the composition in an amount of 80 to 10% by weight based on the total weight of the composition, the sealant characterized by a viscous core;

combining the components to form a first component/sealant/second component laminate; and stitching the components together with the threaded needle, the needle forming a hole through the laminate, the needle carrying the viscous core of the sealant into the hole and filling and sealing the hole, the sealant thereby forming the stitched construction, the stitched construction having a water-impermeable seal between the stitched components and characterized in that the stitched construction exceeds the water immersion flex test at more than 8,000 flexes.

2. The method of claim 1 wherein the first component comprises a welt.

3. The method of claim 2 wherein the second component comprises rib.

4. The method of claim 1 wherein the first component comprises a rib.

5. The method of claim 1 wherein the first component comprises an upper.

6. The method of claim 5 wherein the second component comprises a rib.

7. The method of claim 5 wherein the second component comprises a liner.

8. The method of claim 1 wherein the second component comprises a welt.

9. The method of claim 8 which comprises a third component in the laminate, said third component comprising a rib.

10. The method of claim 9 wherein there is a fourth component in the laminate, said fourth component comprising a liner.

11. The method of claim 1 wherein one of said footwear components comprises a heel section having an inner sole, further comprising:

fastening a laminate of an upper and the sealant to the inner sole, the sealant bonding to the inner sole.

12. The method of claim 11 wherein the laminate comprises a lining.

13. The method of claim 11 which comprises:

interposing a sealing gasket between the sealant and the inner sole.

14. The method of claim 1 which comprises:

applying the sealant to one of said components as a bead.

15. The method of claim 1 which comprises:

applying the sealant to release paper;

applying the release paper to one of said components; and removing the release paper whereby when the release paper is removed the sealant remains adhered to said one component.

16. The method of claim 1 which wherein the amorphous polyolefin is in amount of about 60% by weight based upon the total weight of the composition and the amorphous polyalphaolefin is in an amount of about 40% by weight based upon the total weight of the composition.

* * * * *